US006715298B2

(12) United States Patent
Guo et al.

(10) Patent No.: US 6,715,298 B2
(45) Date of Patent: Apr. 6, 2004

(54) INDIRECT THERMOELECTRIC COOLING DEVICE

(75) Inventors: Chen Guo; Junling Gao, both of Shijiazhuang (CN)

(73) Assignee: Hebei Energy Conservation Investment Co., Ltd. (CN)

( * ) Notice: Subject to any disclaimer, the term of this patent is extended or adjusted under 35 U.S.C. 154(b) by 21 days.

(21) Appl. No.: 09/943,300

(22) Filed: Aug. 31, 2001

(65) Prior Publication Data

US 2002/0170296 A1 Nov. 21, 2002

(30) Foreign Application Priority Data

May 18, 2001 (CN) ..... 01224156

(51) Int. Cl.[7] ..... F25B 21/02
(52) U.S. Cl. ..... 62/3.2; 62/3.6; 62/440
(58) Field of Search ..... 62/3.2, 3.6, 3.7, 62/440, 453; 136/203, 204

(56) References Cited

U.S. PATENT DOCUMENTS 3,732,702 A * 5/1973 Desch ..... 62/3
4,007,600 A * 2/1977 Simms ..... 62/3
5,715,684 A * 2/1998 Watanabe et al. ..... 62/3.2
5,813,233 A * 9/1998 Okuda et al. ..... 62/3.7

FOREIGN PATENT DOCUMENTS

JP 6-174329 * 6/1994 ..... 62/3.2

* cited by examiner

*Primary Examiner*—Melvin Jones
(74) *Attorney, Agent, or Firm*—Cook, Alex, McFarron, Manzo, Cummings & Mehler, Ltd.

(57) ABSTRACT

An indirect thermoelectric cooling device comprises a thermoelectric cooling plate, in the indirect thermoelectric cooling device, a heat dispersing member is connected to the hot end of the thermoelectric cooling plate, and a cooling transmitting member is connected to the cold end of the thermoelectric cooling plate, characterized in that an inside mid-frame is provided between the heat dispersing member and cooling transmitting member, an outside mid-frame which is of a shape of sleeve is provided to surround the inside mid-frame, and the thermoelectric cooling plate is sandwiched between the inside mid-frame and the outside mid-frame. According to the present invention, there exist less connecting portions in the route of the cold or hot gas transferring, thus decreasing the heat resistant, and increasing the cooling or heating transmit efficiency, so that the heat dispersing and the cooling transmitting can be both realized in the same device. Since the heat exchanging is forced to be performed by means of a ventilator or fan, the generated cold gas can not be halted at the cold end, so that it is quick to get cold enough gas, and more cold gas can be generated.

5 Claims, 6 Drawing Sheets

INDIRECT THERMOELECTRIC COOLING DEVICE

The present invention relates to a thermoelectric cooling device, and more particularly, to an indirect thermoelectric cooling device.

In the prior art, there basically exit two kinds of ways to connect a cooling device, a heat dispersing member and a cooling transmitting member to each other. (1) One of the two ways is that the heat dispersing member provided on the hot end of the cooling device is connected to a cold storage block or the cooling transmitting member by means of screws and insulating materials. (2) The other way is that the heat dispersing member, the cooling device and the cooling transmitting member are connected to each other by intermediate means, in which any heat short-circuit is prevented between the heat dispersing member and the cooling transmitting member (as disclosed in CN Patent No.98202764.8). The first way has an advantage of simple connection, but has a disadvantage of the heat short-circuit. The second way has an advantage of no heat short-circuit, but has a disadvantages of poor assembly repeatability and low assembly efficiency. CN Patent No.00243792.9 provides a simple solution of assembling the thermoelectric cooling device, which has overcome the above-mentioned drawbacks of poor assembly repeatability and low assembly efficiency, but still has such a disadvantage that the cooling transmitting member has two connecting zones in the cooling device, thus the heat resistant is increased, resulting in that more generated cold gas is lost, so that less cold gas can be used for refrigerating. Therefore, the main aim desired to be realized in the manufacture of the thermoelectric cooling equipment is to provide a thermoelectric cooling device which is easy to be developed, convenient to be assembled, reasonable in structure, more in cold gas generation, and high in refrigerating efficiency.

The object of the present invention is to overcome the above-mentioned drawbacks, and provide an indirect thermoelectric cooling device which is simple in structure, high in assembling efficiency, good in assembly repeatability, more in cold gas generation, and quick in getting cold enough gas.

The object of the present invention is realized as follows.

An indirect thermoelectric cooling device comprises a thermoelectric cooling plate, in the indirect thermoelectric cooling device, a heat dispersing member is connected to the hot end of the thermoelectric cooling plate, and a cooling transmitting member is connected to the cold end of the thermoelectric cooling plate, characterized in that an inside mid-frame is provided between the heat dispersing member and cooling transmitting member, an outside mid-frame which is of a shape of sleeve is provided to surround the inside mid-frame, and the thermoelectric cooling plate is sandwiched between the inside mid-frame and the outside mid-frame.

Preferably, the cooling transmitting member can be any one of a finned cooling transmitting member, a pinboard cooling transmitting member, a ribbed cooling transmitting member, and a needle cooling transmitting member.

Preferably, a ventilator is provided to be adjacent to the cooling transmitting member.

Preferably, the ventilator can be any one of a centrifugal ventilator, an axial-flow ventilator, and a rotating-flow ventilator.

Preferably, an evaporator which has a cavity with trapezoidal cross sections is provided on a tube of the heat dispersing member, or an evaporating chamber with a shape of a plate can also be used in the heat dispersing member.

Preferably, said outside mid-frame is fixed to a wall of the refrigerator which has an insulating layer, the ventilator which is provided to be adjacent to the cooling transmitting member is provided to communicate with a ventilating passage, the ventilating passage is provided to communicate with the refrigerating chamber of the refrigerator.

Preferably, said ventilator which communicates to the cooling transmitting member of the refrigerator through the ventilating passage can also be provided on a refrigerating equipment located off the refrigerator body.

The present invention is of improvements on the basis of the technical solutions disclosed in CN Patent No.00243792.2, entitled with A SIMPLE ATTACHMENT FOR ASSEMBLING THE THERMOELECTRIC COOLING DEVICE, in which the mid-frame pressing plate is changed as a finned cooling transmitting member, a pinboard cooling transmitting member, a ribbed cooling transmitting member, or a needle cooling transmitting member. As said cooling device and its surrounding air are forced to convective heat exchange by means of a ventilator or fan, the heat exchange efficiency is greatly increased, so that the indirect cooling operation is realized. Moreover, the indirect thermoelectric cooling device itself is a complete and independent heat dispersing-cooling system, and no cold storage block (heat sink) is provided between the thermoelectric cooling device and the cooling transmitting member, therefore, no other connecting zones exist in the thermoelectric cooling device. In this way, the generated cold gas lost is decreased in the process of the cold gas transmitting. As the heat exchange is forced to do by means of air cooling method, the heat exchange efficiency is high, so that no cold gas is halted in the cooling transmitting member, as a result, more cold gas can be generated, and it is quick to get cold enough gas. Therefore, the present invention also has the advantages of the CN Patent entitled with A SIMPLE ATTACHMENT FOR ASSEMBLING THE THERMOELECTRIC COOLING DEVICE, i.e. being simple in structure, easy in installation, high in assembling efficiency, easy in measurement. In addition, the present invention also has the advantages of being more in cold gas generation, quick in getting cold enough gas, widely used in several kinds of thermoelectric cooling devices.

The most notable advantage of the present invention is that there exist less connecting zones in the route of the cold or hot gas transmitting, thus decreasing the heat resistant and increasing the cooling or heating transmit efficiency, so that the heat dispersing and the cooling transmitting can be both realized in the same device. Since the heat exchanging is forced to be performed by means of a ventilator or fan, the generated cold gas can not be halted at the cold end, so that it is quick to get cold enough gas, and more cold gas can be generated.

When the thermoelectric cooling device according to the present invention is used in the refrigerator, the noise resulted from the operation of the refrigerator is kept low enough with reasons that the ventilator is provided within the refrigerator body, and the heat dispersing is performed outside of the refrigerator body by means of natural convective method. As the convective heat exchanging in the refrigerator body is forced to be performed by means of a ventilator or fan, the generated cold gas can not be halted at the cold end of the thermoelectric cooling device, so that it is quick to get cold enough gas, and more cold gas can be generated. Especially, the uniform temperature can be realized in the thermoelectric cooling device. Therefore, the thermoelectric cooling device according to the present invention is of applicability in industry.

The thermoelectric cooling device according to the present invention will be described together with the accompanying drawings as follows.

List of Reference Numbers

Figure 1:
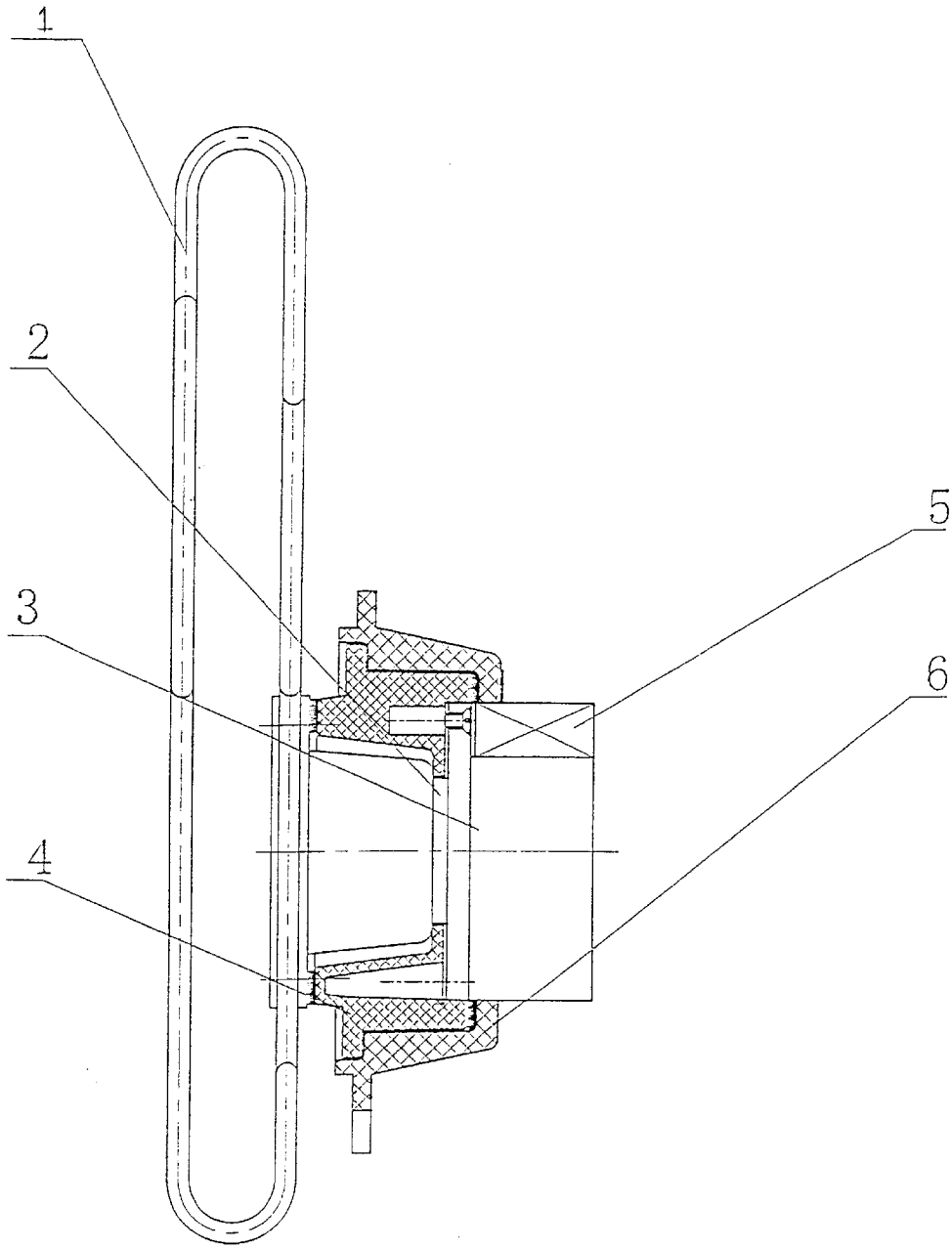
FIG. 1 is a schematic view of one embodiment of the thermoelectric cooling device according to the present invention (the ventilator and the cooling transmitting member are connected to each other)

| | |
|---|---|
| 1. the heat dispersing member | 2. the thermoelectric cooling device |
| 3. the cooling transmitting member | 4. the inside mid-frame |
| 5. the ventilator | 6. the outside mid-frame |
| 7. the refrigerator body | 8. the insulating layer |
| 9. the ventilating passage | 10. the evaporator |
| 11. the evaporating chamber | |

As shown in FIGS. 1, 2, 3, and 4, the present invention is directed to an indirect thermoelectric cooling device. A heat dispersing member 1 is provided on the hot end of the thermoelectric cooling plate 2. On the other hand, a cooling transmitting member 3 is provided on the cold end of the thermoelectric cooling plate 2.

An inside mid-frame 4 which is hollow and has trapezoidal cross sections is provided in the thermoelectric cooling device. An outside mid-frame 6 which has a shape of the sleeve is provided to surround the inside mid-frame 4. The outside mid-frame 6 is tightly contacted to the thermoelectric cooling plate 2 on one side thereof. The inside mid-frame 4 is tightly contacted to the thermoelectric cooling plate 2 on other side thereof. Every concerned members are connected together so as to form the device by means of screws for example.

In the possible embodiments, the cooling transmitting member 3 can be any one of a finned cooling transmitting member, a pinboard cooling transmitting member, a ribbed cooling transmitting member, and a needle cooling transmitting member.

Figure 2:
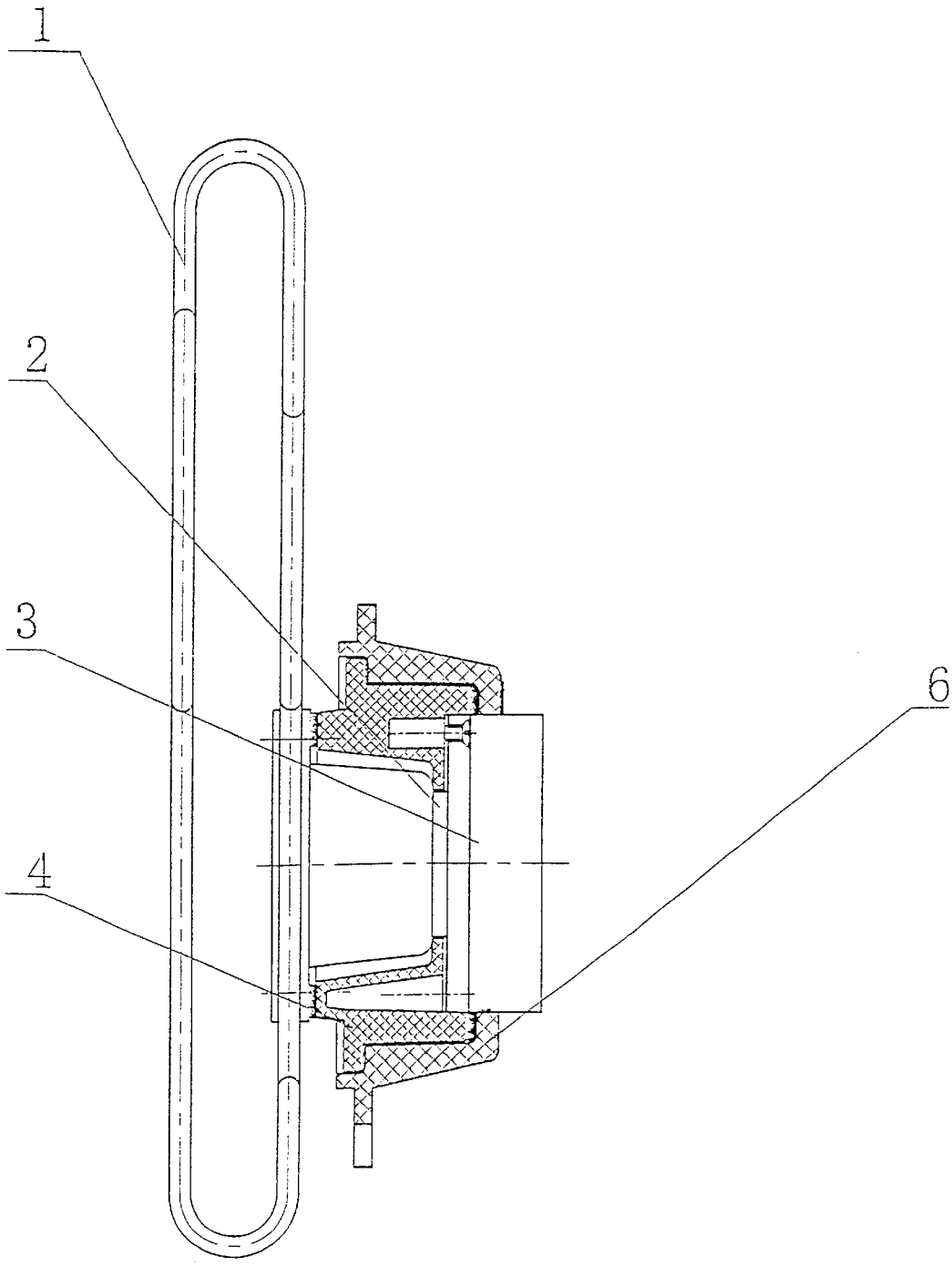
FIG. 2 is a schematic view of another embodiment of the thermoelectric cooling device as shown in FIG. 1 (the ventilator is not connected to the cooling transmitting member, but to another cooling component)
Figures 3, 4:
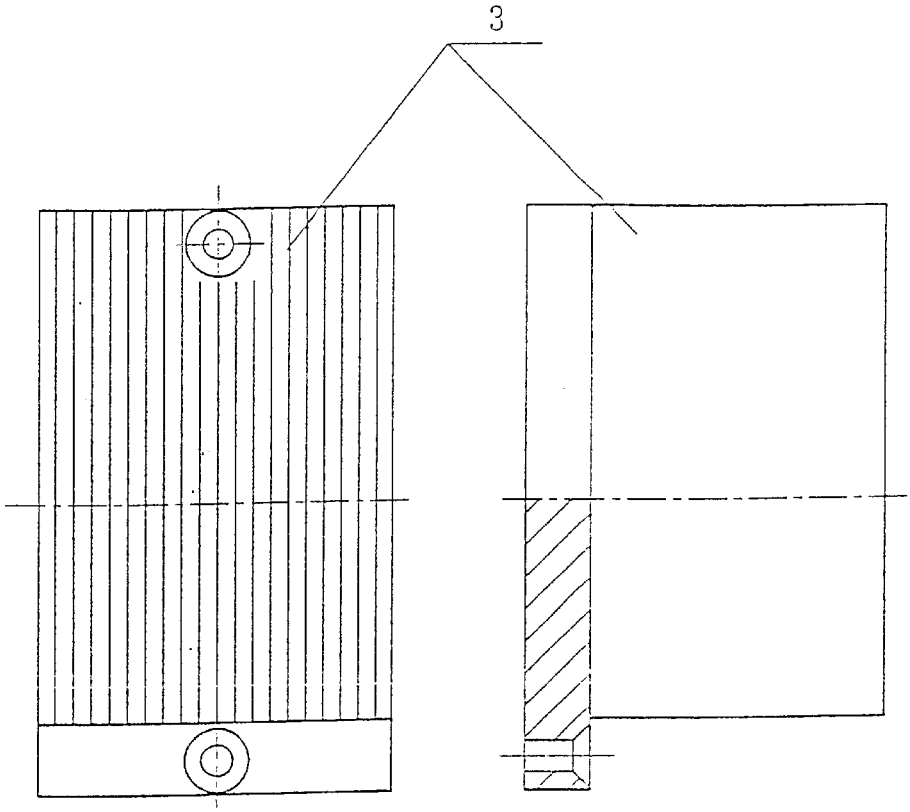
FIG. 3 is a schematic view of one embodiment of the cooling transmitting member as a finned cooling transmitting member according to the present invention.
FIG. 4 is a side view of the cooling transmitting member as shown in FIG. 3.

In the embodiments as shown in the FIGS. 1 and 2, a ventilator 5 is provided to be adjacent to the cooling transmitting member 3.

The ventilator 5 can be any one of a centrifugal ventilator, an axial-flow ventilator, and a rotating-flow ventilator.

Figure 7:
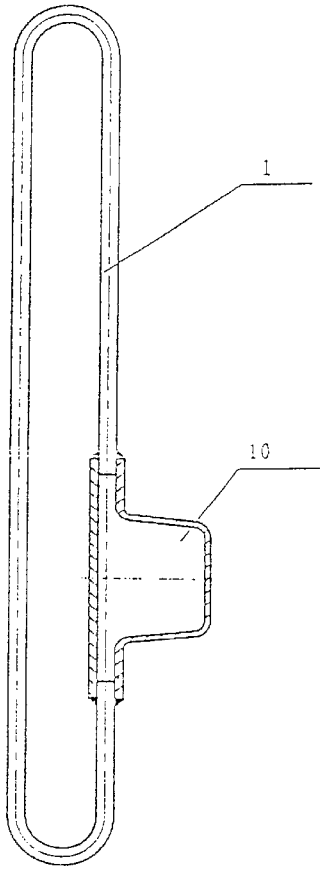
FIG. 7 is a schematic view of one embodiment of a heat dispersing member with an evaporator according to the present invention.
Figure 8:
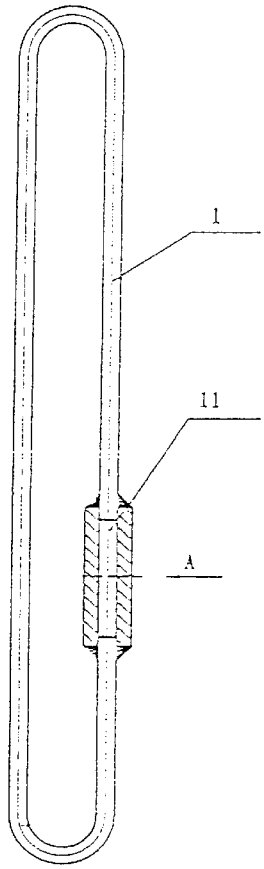
FIG. 8 is a schematic view of another embodiment of a heat dispersing member as shown in FIG. 7.
Figure 9:
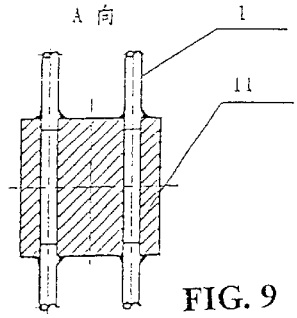
FIG. 9 is a partial view of the heat dispersing member along the direction A as shown in FIG. 8.
Figure 10:
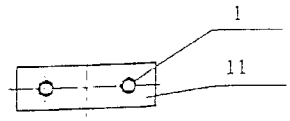
FIG. 10 is a plan view of the heat dispersing member as shown in FIG. 9.

As shown in FIG. 7, an evaporator 10 which has a cavity with trapezoidal cross sections is provided on a tube of the heat dispersing member. In addition, as shown in the FIGS. 8, 9 and 10, an evaporating chamber 11 with a shape of a plate can also be used in the heat dispersing member 1.

Figure 5:
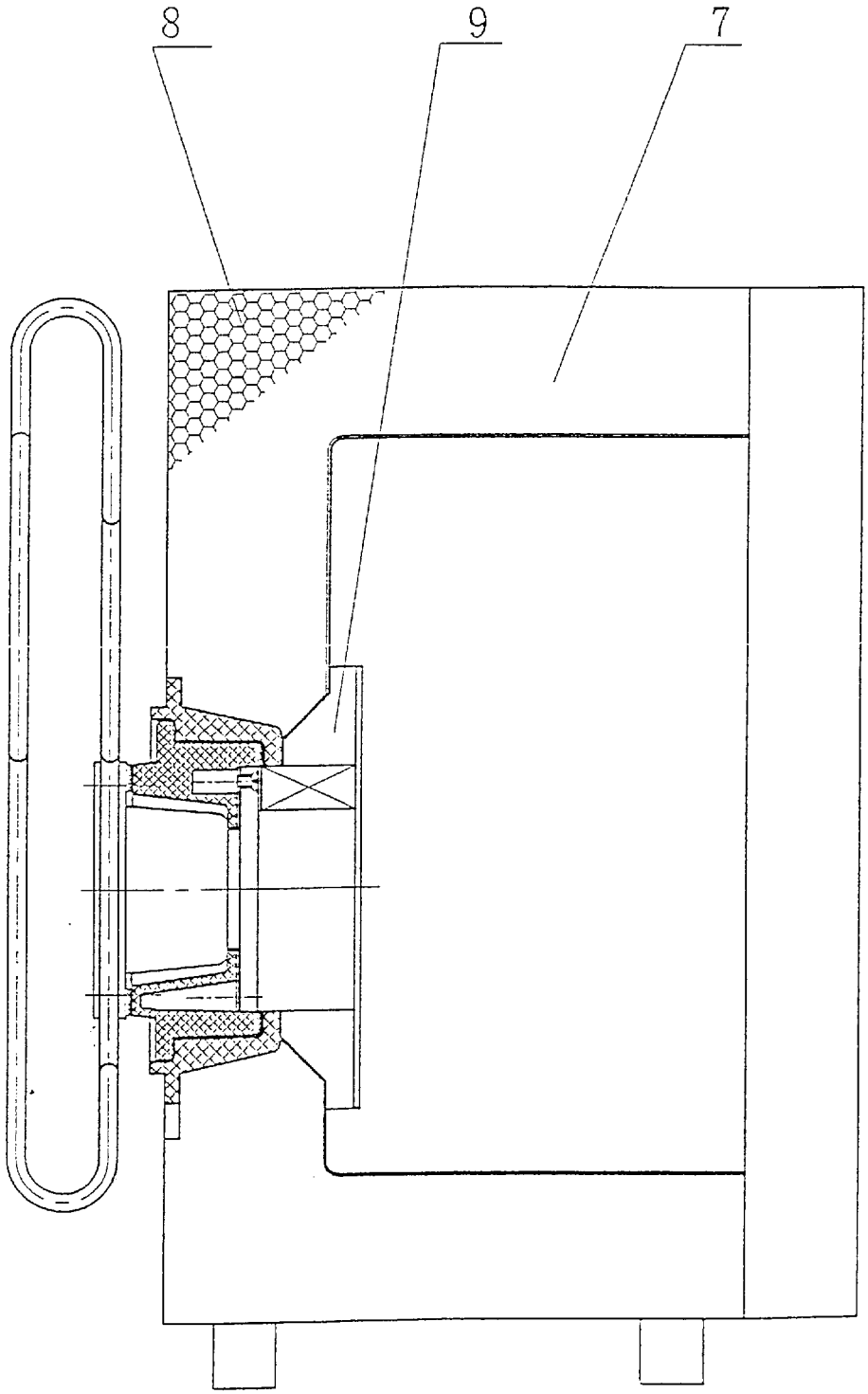
FIG. 5 is a schematic view of one embodiment of the thermoelectric cooling device as shown in FIG. 1 used in the refrigerator.
Figure 6:
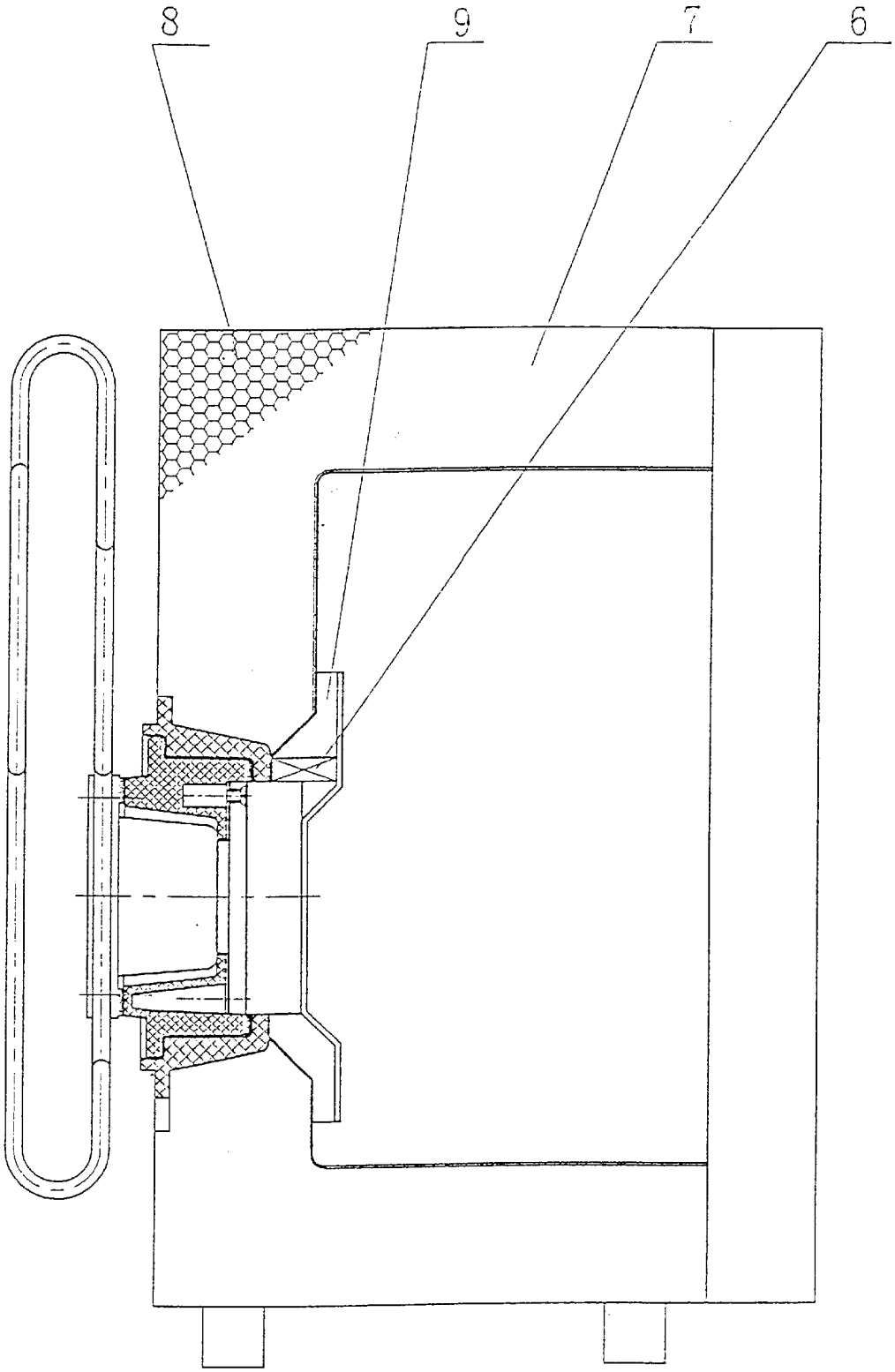
FIG. 6 is a schematic view of one embodiment of the thermoelectric cooling device as shown in FIG. 2 used in the refrigerator.

As shown in FIGS. 5 and 6, said outside mid-frame 6 is fixed to a wall of the refrigerator which has an insulating layer 8. The ventilator 5 which is provided to be adjacent to the cooling transmitting member 3 is provided to communicate with a ventilating passage 9. The ventilating passage 9 is provided to communicate with the refrigerating chamber of the refrigerator.

In other embodiments, said ventilator 5 which communicates to the cooling transmitting member 3 of the refrigerator through the ventilating passage can also be provided on a refrigerating equipment located off the refrigerator body.

What is claimed is:

1. An indirect thermoelectric cooling device comprising a thermoelectric cooling plate (2), in which a heat dispersing member (1) is connected to the hot end of the thermoelectric cooling plate (2), and a cooling transmitting member (3) is connected to the cold end of the thermoelectric cooling plate (2);

an inside mid-frame (4) is provided between the heat dispersing member (1) and cooling transmitting member (3), an outside mid-frame (6) which is of a shape of sleeve is provided to surround the inside mid-frame (4), and the thermoelectric cooling plate (2) is sandwiched between the inside mid-frame (4) and the outside mid-frame (6); and a ventilator (5) is provided to be adjacent to the cooling transmitting member (3).

2. An indirect thermoelectric cooling device as claimed in the claim 1, characterized in that the ventilator (5) can be any one of a centrifugal ventilator, an axial-flow ventilator, and a rotating-flow ventilator.

3. An indirect thermoelectric cooling device as claimed in the claim 1, characterized in that an evaporator (10) which has a cavity with trapezoidal cross sections is provided on a tube of the heat dispersing member (1), or an evaporating chamber (11) with a shape of a plate can also be used in the heat dispersing member.

4. An indirect thermoelectric cooling device as claimed in the claim 1, characterized in that said outside mid-frame (6) is fixed to a wall of the refrigerator which has an insulating layer (8), the ventilator (5) which is provided to be adjacent to the cooling transmitting member (3) is provided to communicate with a ventilating passage (9), the ventilating passage is provided to communicate with the refrigerating chamber of the refrigerator.

5. An indirect thermoelectric cooling device as claimed in the claim 4, characterized in that said ventilator (5) which communicates to the cooling transmitting member (3) of the refrigerator through the ventilating passage can also be provided on a refrigerating equipment located off the refrigerator body.

* * * * *